US008714767B2

(12) United States Patent
Sears

(10) Patent No.: US 8,714,767 B2
(45) Date of Patent: May 6, 2014

(54) MODULAR STAIR UNIT

(76) Inventor: Ernest Halsey Sears, Manassas, VA (US)

( * ) Notice: Subject to any disclaimer, the term of this patent is extended or adjusted under 35 U.S.C. 154(b) by 936 days.

(21) Appl. No.: 11/970,026

(22) Filed: Jan. 7, 2008

(65) Prior Publication Data

US 2009/0175030 A1 Jul. 9, 2009

(51) Int. Cl.
*F21S 8/00* (2006.01)
*F21V 15/00* (2006.01)

(52) U.S. Cl.
USPC ..... 362/146; 362/369; 362/390; 362/355

(58) Field of Classification Search
USPC ..... 362/145, 146, 186, 190, 191, 360, 367, 362/355, 356, 368, 369, 390; 52/28, 306, 52/182, 307
See application file for complete search history.

(56) References Cited

U.S. PATENT DOCUMENTS

| | | | | |
|---|---|---|---|---|
| 934,122 | A | 9/1909 | Woodman | |
| 2,756,323 | A | 4/1953 | Tusly | |
| 4,425,601 | A | 1/1984 | Donahue | |
| 4,612,606 | A | 9/1986 | Roberts | |
| 5,222,799 | A | 6/1993 | Sears et al. | |
| 5,463,541 | A * | 10/1995 | Greene | 362/369 |
| 5,539,623 | A * | 7/1996 | Gurz et al. | 362/20 |
| 5,729,925 | A * | 3/1998 | Prothero | 40/570 |
| 5,749,643 | A | 5/1998 | Porter et al. | |
| 6,685,332 | B1 | 2/2004 | Clark | |
| 7,360,910 | B2 * | 4/2008 | Korral et al. | 362/30 |

* cited by examiner

*Primary Examiner* — Thomas Sember

(57) ABSTRACT

The present invention includes a modular stair unit, and kit for assembling the modular stair unit, that may be utilized as either a stair tread or stair riser. The modular stair unit includes a body, housing adjoined therewith, and light source within the housing. The body includes a generally planar dorsal surface and a ventral surface and forms a void between the dorsal surface and the ventral surface, which allows light passage. It is preferred that interior surfaces of the housing are fabricated of a substantially diffusive material.

13 Claims, 5 Drawing Sheets

MODULAR STAIR UNIT

FIELD OF THE INVENTION

The present invention relates to the field of building construction components and more specifically to the field of stairway lighting.

BACKGROUND

The external stairways of houses are often decorative. The stairways include intricate pathways, utilize fancy materials in their construction, or include attractive lighting schemes and devices. Of the forms of stairway decoration, the use of lighting for the sake of decoration is currently the least prominent. Often stairways will emphasize purely functional devices, for example: simple metal posts bearing lanterns, or lighting instruments strategically affixed to the external stairway. The safety concerns of poorly lighted stairs are significant, but stairway lighting can be aesthetically pleasing as well as functional.

Different means of illuminating stairways have been developed. U.S. Pat. No. 2,756,323, for example, discloses a stairway with apertures formed between the riser and the tread. A single light source, or multiple light sources forming a single light source assembly, within an interior chamber of the stairway stretches from the base of the stairway to the apex of the stairway. Light from the light source is transmitted through the stairway chamber to a series of mirrors each positioned near one aperture. The mirrors accept the light transmitted from the light source, and reflect it downward through the aperture onto the top surface of each stair.

The '323 patent application presents a stairway designed exclusively for functional lighting purposes, without regard to aesthetics, ease of construction, delivery, repair, or replacement. This device relies on a single light source, or lengthy light source assembly, to illuminate all of the treads of a stairway. Accordingly, the light source would have to be customized to the exact dimensions of each stairwell for which it is intended to be used. The use of a single reflector within the staircase to deflect the light through the gap between the riser and tread creates an awkward reflection system that may effectively convey light throughout the invention at some points, but not others. In addition to the structural and mechanical awkwardness, the structure of the disclosure includes multiple safety concerns. And interestingly, it is the features of this device that promote safety that simultaneously pose the greatest safety concerns. The stairwell forms a large gap between the overhanging tread and riser. The existence of a protrusion on the overhanging tread creates an obstacle for a user's foot. The existence of the gap between the riser and tread poses a farther obstacle to the human foot, which may be caught therein.

U.S. Pat. No. 934,122 discloses a set of steps with multiple openings occupied by colored glass. Within the set of steps are multiple bulbs positioned on shelves proximate to the glass-covered openings. Contacts are located on the tread of the steps, which are in electrical communication with the bulbs, and as pressure is placed on a step, the bulb near that step illuminates.

In contrast to the teachings of the '323 patent, the '122 patent discloses a device that is purely aesthetic. While the glass-covered openings on each step may possess certain decorative qualities, those decorative qualities are related to displaying the ornamentation of the glass within the opening rather than simply the light—or allowing the light access to the exterior of the stairwell in a meaningful fashion. The electric light lamps rest upon shelves permanently affixed to interior sides of the stairway. A stairway built according to this disclosure would require custom construction and have very limited uses.

Therefore, there is a need for an invention that can effectively illuminate each step of a stairway, is inexpensive, allows modularity, allows installation on pre-existing stairways, allows the visual effects of light to be cleanly displayed to a viewer, that can effectively present the visual display of light, and allows simple installation.

SUMMARY

The present invention is directed to a modular stair unit, and kit for assembling the modular stair unit, that may be utilized as either a stair tread or stair riser. The modular stair unit includes a body with a generally planar dorsal surface and a ventral surface. The body forms a centrally located void between the dorsal surface and the ventral surface, which allows light passage. A housing is mounted on the ventral surface of the body and includes an interior backing surface that includes a light transmission aperture near the ventral surface of the body. It is preferred that interior surfaces of the housing are fabricated of a substantially diffusive material. A light source is positioned within the housing to emit light through both the transmission aperture and the void within the body. A power source inlet powers the light source.

The preferred housing of the present invention includes a diffusive rear backing surface and diffusive side surfaces surrounding the rear backing surface, and a diffusive ceiling abutting the side surfaces to form the transmission aperture. Surrounding the light source with substantially diffusive surfaces allows for maximized internal light reflection throughout the housing. A substantially translucent plate may be placed across the transmission aperture to shield the interior light source and to diffuse light that emanates from the light source. A further form of protection for the light source may include an absorption member contacting the light source to absorb shock from pressure placed on the body. The housing may include an access port to allow simple replacement of the light source within the housing. To allow simplified installation the power source inlet may be mounted to the housing, and a power source outlet may similarly be mounted to the housing.

A kit of parts for the modular stair unit includes the unit body and the housing. The housing is adapted to be mounted to the ventral surface of the body by means of a mounting assembly, which may include any standard attachment devices. The light source is positioned within the housing. The substantially translucent plate may further be adapted to be affixed to the housing.

Therefore, it is an aspect of the present invention to present a lighted stairway component capable of effectively illuminating a stairway.

It is a further aspect of the present invention to present a lighted stairway component that is inexpensive.

It is a further aspect of the present invention to present a stairway component that allows modularity.

It is a further aspect of the present invention to present a stairway component that allows installation on pre-existing stairways.

It is a further aspect of the present invention to present a stairway component that allows the visual effects of light to be cleanly displayed to a viewer.

It is a further aspect of the present invention to present a stairway component that allows the soft-lighting visual effects be displayed to a viewer.

It is a further aspect of the present invention to present a stairway component that effectively presents the visual display of light.

It is a further aspect of the present invention to present a stairway component that allows simple installation.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
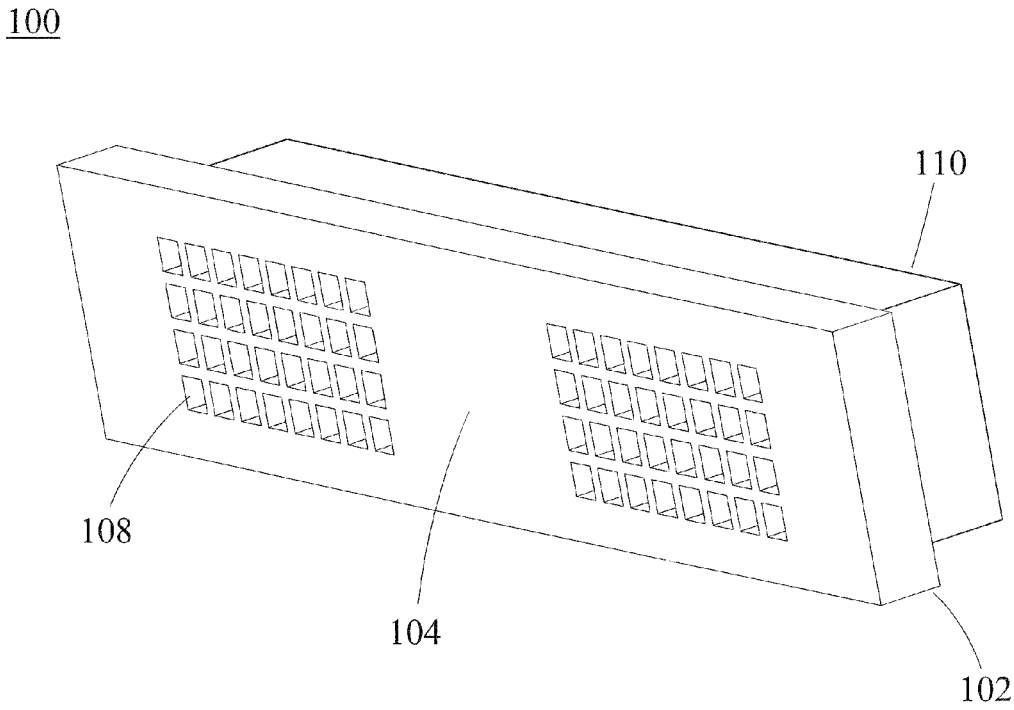
FIG. 1 is a front, perspective view of the modular stair unit.
Figure 2:
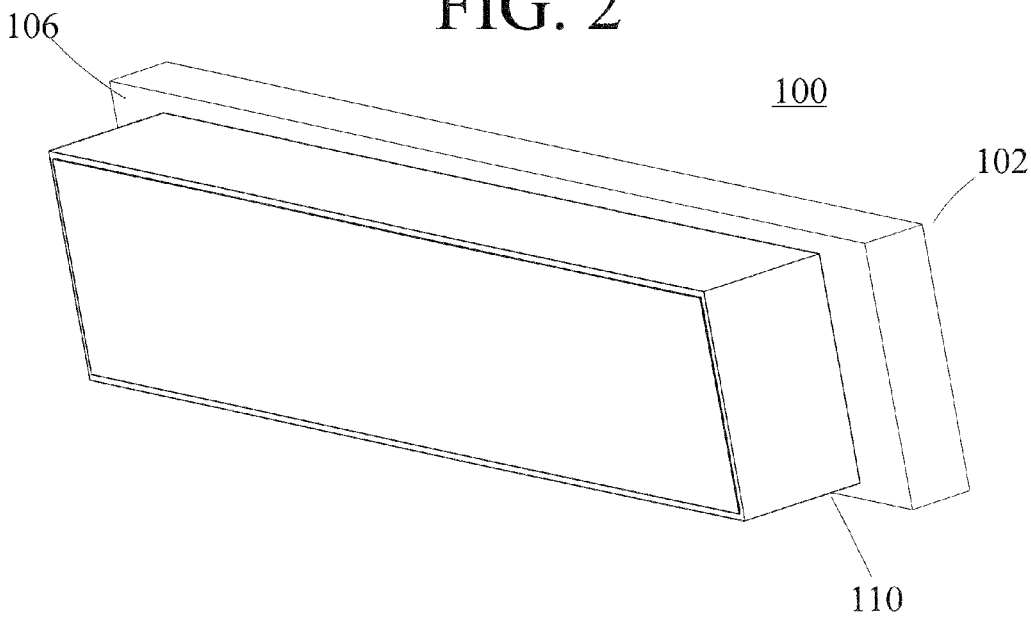
FIG. 2 is a rear, perspective view of the modular stair unit.

Referring first to FIGS. 1 and 2, an embodiment of the modular stair unit 100 is shown. The modular stair unit 100 includes a body 102 with a substantially planar dorsal surface 104. As the modular stair unit 100 of the present invention is intended to serve as either a stair tread or stair riser, it is preferred that the dorsal surface 104 include dimensions appropriate to accept a human foot safely, in the case of a stair tread; and not to obstruct the descent and ascent of a human foot, in the case of a stair riser. The ventral surface 106 of the unit body 102 includes minimal restraints on its dimensions, only that the surface be capable of receiving a housing 110 mounted thereto.

A series of voids 108 within the body 102 span between the dorsal surface 104 and the ventral surface 106. The voids 108 allow light passage emanating from a light source (not shown) within the housing 110. Centrally locating the voids within the dorsal surface 104 of the body 102 is preferred, which allows light transmission to be accentuated. The voids 108 preferably have no substantial obstructions therein. A substantial obstruction is an obstruction that alters the physical characteristics of light passing therethrough, or redirects light passing therethrough in a direction other than simple passage through the void 108. The voids 108 may be of any size or shape that allows safe passage to a human traversing the modular stair unit 100 and allows the transmission of light. Although typically discussed in terms of multiple voids, the present invention may include a single void. Multiple, small voids are preferred as minimizing void size minimizes the likelihood of a human's foot getting caught within the void in the case of riser use, and minimizes the likelihood of objects falling into the void in the case of tread use. The portion of the void 108 proximate to the ventral surface 106 is positioned directly proximate to the housing 110.

Figure 3:
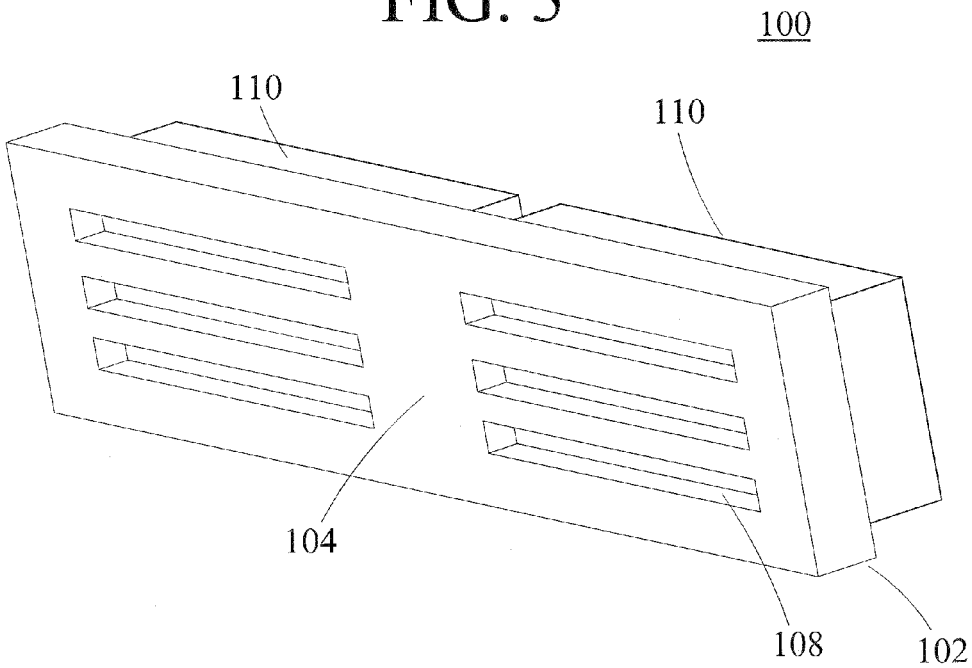
FIG. 3 is a front, perspective view of the modular stair unit.
Figure 4:
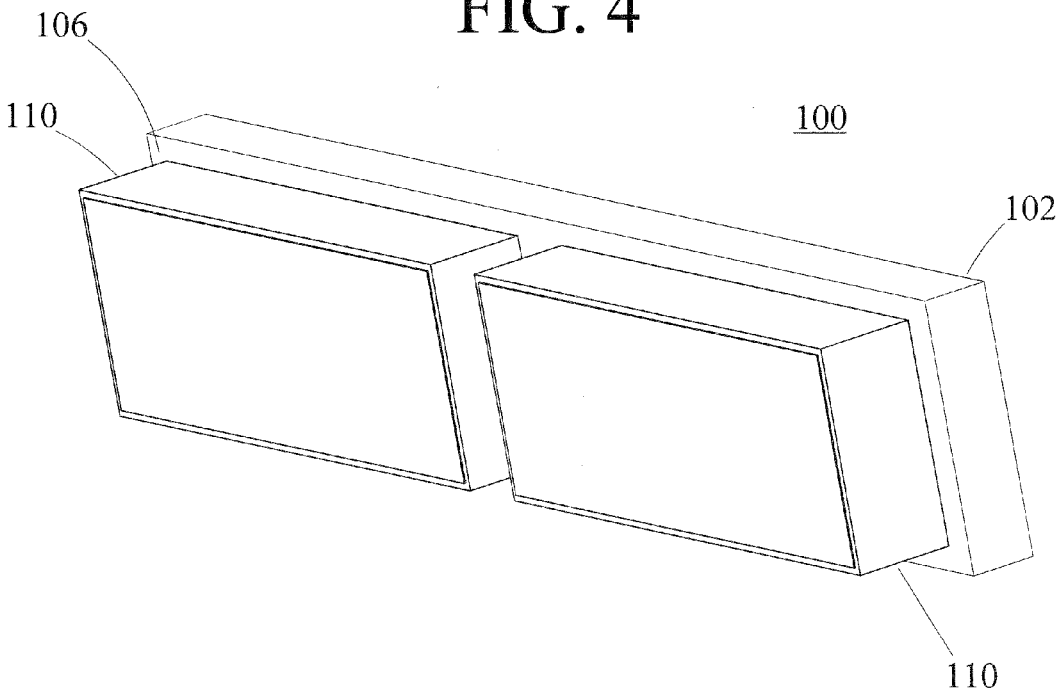
FIG. 4 is a rear, perspective view of the modular stair unit.
Figure 5:
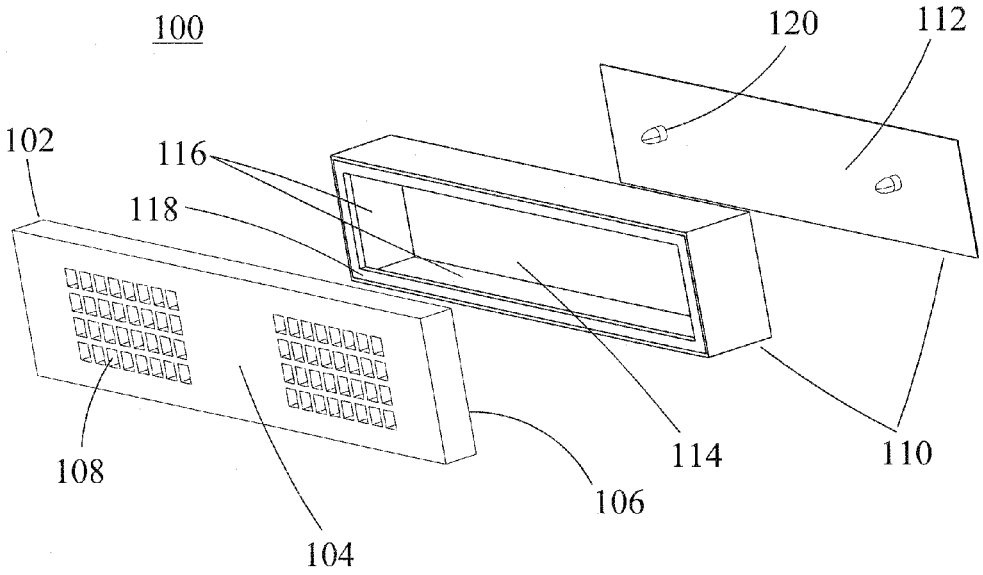
FIG. 5 is an exploded, perspective view of the modular stair unit.

The housing 110 of the present invention is mounted on the ventral surface 106 of the body 102. By mounted, it is meant that a portion of the housing 110 contacts a portion of the ventral surface 106 of the body 102. The connection may be achieved by any fastening device or method currently used in the construction industry, and may be fastened at any combination of locations suitable to achieve an object of the present invention. As FIGS. 3 and 4 show, the body 102 may support any number of housings 110 convenient for the effective use of the present invention. Turning now to FIG. 5, the housing 110 includes a rear backing surface 112 and includes a light transmission aperture 114 for positioning near the ventral surface 106 of the body 102. In addition to a rear backing surface 112, certain versions of the housing 110 may further include one or more side surfaces 116 about the rear backing surface 112. Other versions of the housing 110 may further include a ceiling 118 abutting the side surfaces 116. In embodiments of the present invention with a housing 110 having a ceiling 118, it is preferred that the ceiling 118 form the transmission aperture 114. The light source 120 of the present invention is supported upon the rear backing surface 112 of the housing 110.

The light source 120 of the present invention includes one or more devices for the transmission of light. A suitable light source may include one or more incandescent light bulbs, light-emitting diodes, electroluminescent lamps, a gas discharge lamp, or other light emission device. The light source may be positioned on any surface within the interior of the housing 110 such that light is effectively transmitted through the transmission aperture 114 and through the void 108 of the body 102. The preferred location of the light source 120 within the body will vary with the use of the present invention. In embodiments designed primarily as a stair tread, the light source 120 is positioned offset from a void of the body; in embodiments designed primarily as a stair riser, the light source 120 will have a position centrally located upon the backing surface. Alternatively, in embodiments of the present invention utilizing a housing 110 that lacks a ceiling 118, the light source 120 may be placed directly upon the ventral surface 106 of the body 102 to emit light into the housing 110 to be diffused back through the void 108 of the body 102.

It is preferred that any surface of the housing 110 include, or be fabricated of, a substantially diffusive material. Of the surfaces within the housing which may support a substantially diffusive surface, it is preferred that the backing surface 112 at least include the substantially diffusive surface. A diffusive backing surface 112, of all the surfaces, would most greatly contribute to the capacity of the housing 110 to stretch light emitted from the light source 120 in a two-dimensional manner. By two-dimensional light-stretching, it is meant that an observer positioned in front of a void would notice that light intensity from the light source would diminish more gradually than normal with a simply a light source alone, and that the diminishment would apply to the directions above, below, and to the sides of the light source. It is natural in the emission of light that the intensity of light would correlate to a lean Gaussian distribution of intensity, with the maximum point of the distribution centered directly proximate to the light source 120.

A diffusive surface positioned adjacent to the light source 120 spreads the intensity of the light emission in a two-dimensional manner to provide a more serene visual effect of light transmission through the voids 108 of the body 102. A material adapted to diffuse light is preferred over a material adapted simply to reflect light, e.g. a mirror; although use of diffusive is meant to subsume the capacity to reflect light. A mirror is not preferred as its surface would tend to cause glare, rather than spread the light throughout the housing 110. However, certain embodiments of the present invention may find substantial need to provide high-intensity light stretching which may require a diffusive material capable of reflection. In preferred embodiments of the present invention, the voids 108 of the body 102 work in conjunction with the light source 120 and housing 110 to allow a user to view the soft emission of light within the housing 110. An overly reflective housing interior would intensify light transmission through the void such that beams emanating from the housing would be harshly accepted by the human eye.

Figure 6:
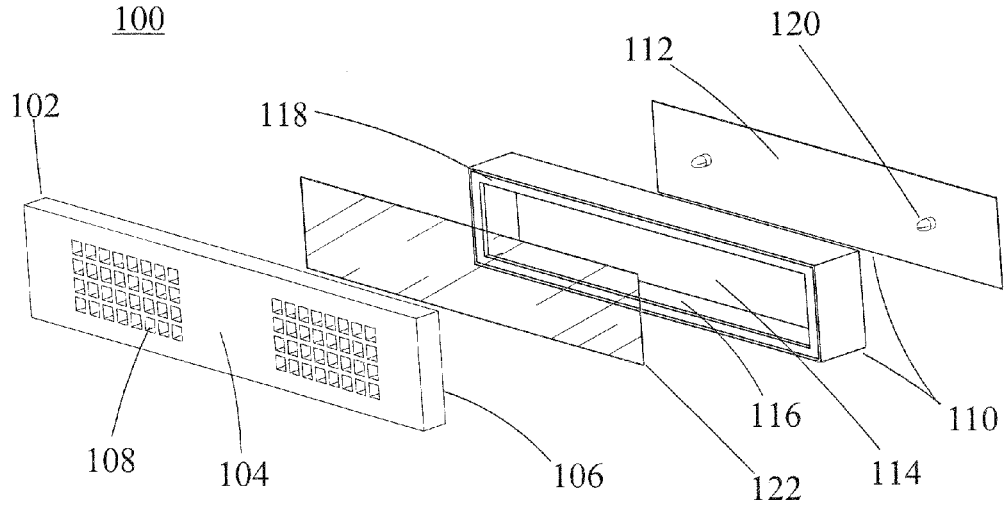
FIG. 6 is an exploded, perspective view of the modular stair unit.

Turning now to FIG. 6, the present invention may further include a diffusion plate 122 to assist in diffusing the light within the housing 110 and suppress glare. The diffusion plate 122 includes a material for allowing the non-uniform scattering of light within the housing, while simultaneously allowing light from the housing to escape therethrough. The diffusion plate 122 is placed over the transmission aperture 114, and is preferably sized to span the entirety of the transmission aperture 114. The diffusion plate 122, in addition to enhancing the visual effect of the present invention, may further serve as a protective covering against objects being able to penetrate the voids 108 to enter the interior of the housing 110. The present invention may alternatively utilize a simple glass sheet, or other translucent and substantially planar component, as a means of protecting the housing 110 interior.

Figure 7:
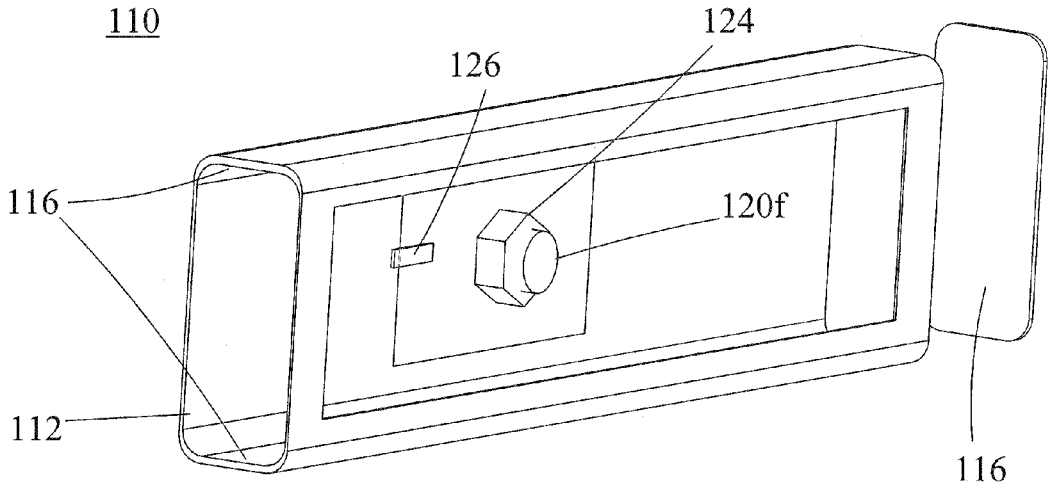
FIG. 7 is a front exploded, perspective view of the housing of the present invention.
Figure 8:
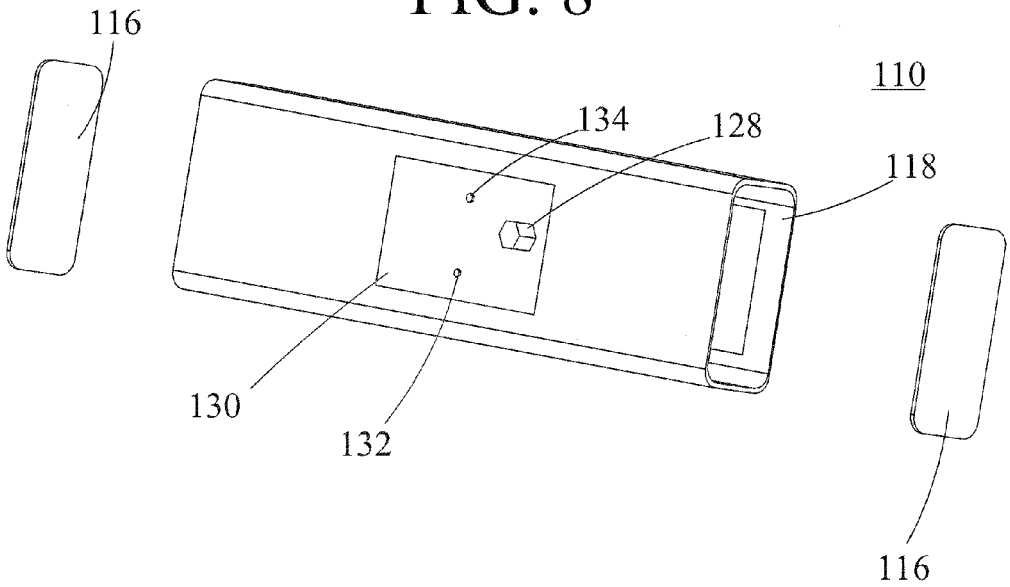
FIG. 8 is a rear exploded, perspective view of the housing of the present invention.

Turning now to FIGS. 7 and 8, a version of the housing 110 is shown. The housing 110 may include the backing surface 112, side surfaces 116, and ceiling 118. In embodiments of the present invention featuring a housing 110 with multiple surfaces, it is preferred that the housing is fabricated from standard hollow PVC extrusions that are cut in various lengths to accommodate the various cuttings. The ends are closed with molded end caps that are glued into place. The PVC surfaces, when white PVC is used, are the preferred surfaces for interior diffusion of light within the housing 110. The housing 110 could be fabricated of word, aluminum, steel, wood, or any other material common to the construction industry. The dimensions of the housing 110 are generally unlimited, to the extent that those dimensions conform to the uses of the particular embodiment used therewith. Certain versions of the housing may include surfaces lacking clear distinction, e.g. a hemisphere. The housing 110 does, however, preferably include a backing surface 112. The backing surface 112 may include any surface that projects proximate to a void in a direction other than strictly perpendicular to the ventral surface of the body. The side surface 116 may include any surface that projects in a direction other than strictly parallel to the ventral surface of the body. The ceiling 118 may include any surface adjacent to, and generally parallel with, the ventral surface of the body.

Proximate to the light source (not shown), an absorption member 124 may be positioned to dampen vibrations flowing from the body (not shown) to the housing 110. The absorption member 124 is preferably a rubber stopper that circumscribes and cradles the light source. The absorption member may include any device known in the art capable of dampening vibration between two objects.

The housing 110 may further include an access port 130. The access port 130 is an opening within the housing 110, or a door covering the opening within the housing 110, that allows a user access to the interior of the housing 110. The access port 130 may be positioned on any portion of the housing 110 capable of allowing a hand direct access to the interior of the housing 110. It is preferred that the access port 130 be positioned directly adjacent to the light source, and it is even more preferred that the light source—or its fixture 120*f*—be positioned upon the access port 130 such that removal or rotation of the access port exposes the light source or fixture to a user. The access port 130 may include any combination of devices amenable to allowing a user access to the interior of an enclosure. Preferred access ports 130 include one or more doors, sliding panels, removable plates, and the like. When a rotatable access port 130 is used, as in the door port of FIGS. 7 and 8, it preferred that a locking mechanism is used such as an externally rotatable knob 128 affixed to an internally rotatable latch 126.

A power inlet 132 allows the light source access to an electrical flow. The present invention may be powered by any electrical device suited to outdoor use, including both alternating current and direct current delivery means. The preferred power inlet 132 is positioned on the housing 110 such that electrical wiring may be affixed to housing 110 exterior rather than the interior of the housing 110. It is further preferred that the housing 110 include a power outlet 134 in electrical communication with the power inlet 132 that allows a user simplified, external access to electricity. The aforementioned external power inlet 132 and power outlet 134 on the housing 110 increases the ease of quickly installing multiple modular stair units in sequence.

Figure 9:
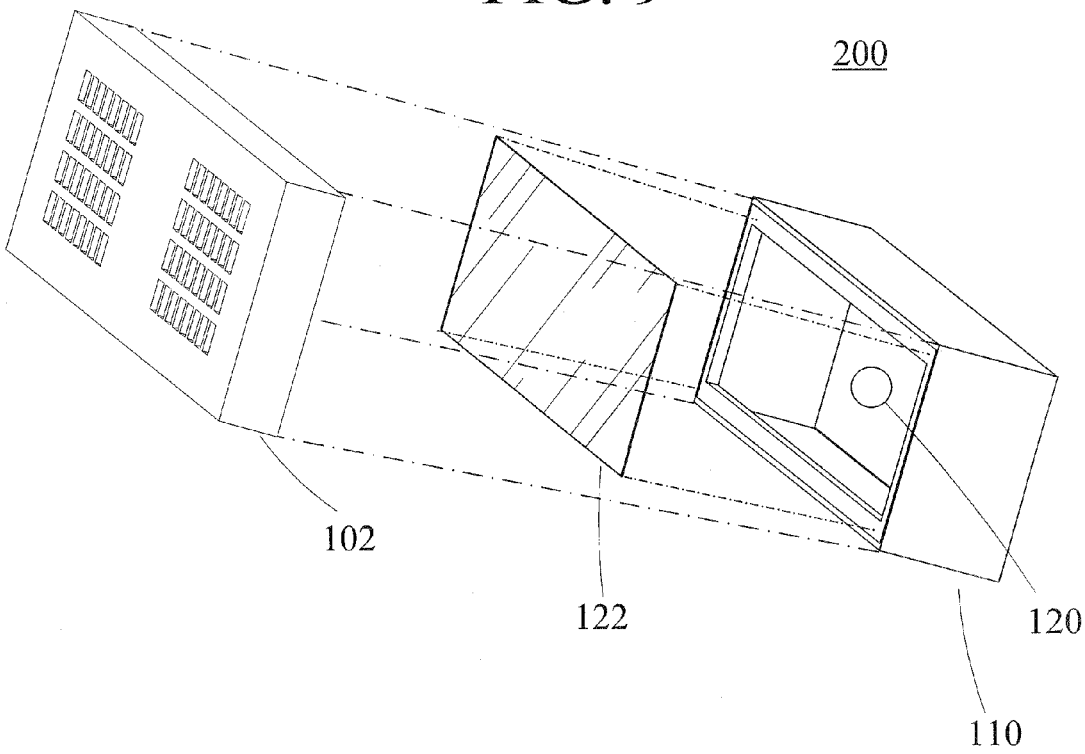
FIG. 9 is an exploded, perspective view of a kit of the present invention.

A preferred kit 200 of the present invention is shown in FIG. 9 and includes the body 102, the housing 110, and the diffusion plate 122 or glass screen. The kit 200 may include any of the components of the modular stair unit, but in a form amenable to quick affixation. It is preferred that the kit 200 include the body 102 separate from the housing 110 with connectors associated therewith for ready assembly. The connectors of the present invention may include any fastening devices available to the home construction industry, including screws, nails, bolts, adhesives, and the like. It is preferred that the diffusion plate 122, when included in the kit 200, be dimensioned to form an interference fit with the housing 110 as it cooperates with the ventral surface 106 of the body 102. The light source (not shown) may be affixed within the housing 110, or amenable to simple affixation within a fixture of the housing 110.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A modular stair unit for creating an illumination effect on a stairway, said stair unit comprising:

a body having a substantially planar dorsal surface and a ventral surface, defining an interior void between said dorsal surface and said ventral surface, said void adapted to allow substantially unobstructed light transmission;

a housing, adjoiningly mounted to said ventral surface of said body, having a substantially diffusive backing surface and forming a transmission aperture proximate to said ventral surface of said body;

a light source positioned within said housing for transmitting light within said housing; a power source inlet in electrical communication to said light source; and an absorption member positioned between said light source and said housing.

2. The stair unit of claim 1 wherein said housing defines an access port positioned distally from said body.

3. The stair unit of claim 2 further comprising a translucent plate spanning said transmission aperture.

4. The stair unit of claim 3 wherein said translucent plate is adapted to diffuse light passing therethrough.

5. The stair unit of claim 1 wherein said housing further includes diffusive side surfaces surrounding said backing surface.

6. The stair unit of claim 5 wherein said housing further includes a diffusive ceiling, abutting said side surfaces, forming said transmission aperture; whereby said backing surface, said side surfaces, and said ceiling substantially engulf said light source for maximizing internal light diffusion throughout said housing.

7. The stair unit of claim 6 further comprising a substantially translucent plate spanning said transmission aperture, whereby said backing surface, said side surfaces, said ceiling, and said translucent plate engulf said light source for maximizing internal light diffusion throughout said housing.

8. The stair unit of claim 1 further wherein said power source inlet is mounted to said housing.

9. The stair unit of claim 8 further comprising a power source outlet mounted to said housing.

10. A modular stair unit for creating an illumination effect on a stairway, said stair unit comprising:

a body having a substantially planar dorsal surface and a ventral surface, defining an interior void between said dorsal surface and said ventral surface;

a housing, adjoiningly mounted to said ventral surface of said body; having a backing surface, side surfaces surrounding said backing surface, and a ceiling abutting said side surfaces, said ceiling forming a transmission aperture proximate to said ventral surface of said body;

a light source, positioned within said housing such that said backing surface, said side surfaces, and said ceiling substantially engulf said light source, for transmitting light within said housing; a power source inlet in electrical communication to said light source; a substantially translucent plate spanning said transmission aperture; and an absorption member positioned between said light source and said housing.

11. The stair unit of claim 10 wherein said light source is positioned to transmit light substantially horizontally through said aperture.

12. The stair unit of claim 10 wherein said backing surface includes a substantially diffusive material.

13. The stair unit of claim 10 wherein said void is adapted to allow substantially unobstructed light transmission.

* * * * *